United States Patent [19]

Moring, III

[11] Patent Number: 4,958,701

[45] Date of Patent: Sep. 25, 1990

[54] STAMP FORMED MUFFLER WITH POCKET-FREE BAFFLE CREASE

[75] Inventor: Walter G. Moring, III, Toledo, Ohio

[73] Assignee: AP Parts Manufacturing Company, Toledo, Ohio

[21] Appl. No.: 499,995

[22] Filed: Mar. 26, 1990

[51] Int. Cl.[5] ..... F01N 7/18

[52] U.S. Cl. ..... 181/282; 181/228; 181/243; 181/272; 181/273

[58] Field of Search ..... 181/212, 228, 230, 240, 181/243, 250, 255, 268, 272, 273, 282

[56] References Cited

U.S. PATENT DOCUMENTS

| | | | |
|---|---|---|---|
| 705,357 | 7/1902 | Keating . | |
| 1,110,040 | 9/1914 | Chatain . | |
| 2,484,826 | 10/1949 | Harley . | |
| 2,484,827 | 10/1949 | Harley . | |
| 2,658,580 | 11/1953 | Trembley . | |
| 2,860,722 | 11/1958 | Gerstung . | |
| 2,902,109 | 9/1959 | Burgess et al. . | |
| 2,943,695 | 7/1960 | Jeffords | 181/243 |
| 3,125,182 | 3/1964 | Earley . | |
| 3,140,755 | 7/1964 | Tranel | 181/282 |
| 3,158,222 | 11/1964 | Richmond | 181/273 |
| 3,176,791 | 4/1965 | Betts et al. | 181/260 |
| 3,198,284 | 8/1965 | Powers . | |
| 3,220,508 | 11/1965 | Nordquest et al. . | |
| 3,412,825 | 11/1968 | Hall . | |
| 3,638,756 | 2/1972 | Thiele | 181/245 |
| 3,650,354 | 3/1972 | Gordon . | |
| 3,709,320 | 1/1973 | Hollerl et al. . | |
| 3,827,529 | 8/1974 | Frietzsche et al. . | |
| 3,852,041 | 12/1974 | Moore et al. . | |
| 4,108,274 | 8/1978 | Snyder | 181/229 |
| 4,109,751 | 8/1978 | Kabelle | 181/247 |
| 4,132,286 | 1/1979 | Hasui et al. | 181/265 |
| 4,165,798 | 8/1979 | Martinez | 181/268 |
| 4,396,090 | 8/1983 | Wolfhugel | 181/282 |
| 4,415,059 | 11/1983 | Hayashi | 181/250 |
| 4,418,790 | 12/1983 | Agnew | 181/268 |
| 4,422,519 | 12/1983 | Nomura et al. | 181/228 X |
| 4,456,091 | 6/1984 | Blanchot | 181/282 |
| 4,523,660 | 6/1985 | Gaddi | 180/228 |
| 4,700,806 | 10/1987 | Harwood | 181/282 |
| 4,736,817 | 4/1988 | Harwood | 181/282 |
| 4,759,423 | 7/1988 | Harwood et al. | 181/282 |
| 4,760,894 | 8/1988 | Harwood et al. | 181/282 |
| 4,765,437 | 8/1988 | Harwood et al. | 181/282 |
| 4,821,840 | 4/1989 | Harwood et al. | 181/282 |
| 4,836,330 | 6/1989 | Harwood et al. | 181/282 |
| 4,847,965 | 7/1989 | Harwood et al. | 29/157 R |
| 4,860,853 | 8/1989 | Moring, III | 181/282 |
| 4,894,987 | 1/1990 | Harwood et al. | 181/282 X |
| 4,901,815 | 2/1990 | Harwood et al. | 181/282 |
| 4,901,816 | 2/1990 | Garey | 181/296 |
| 4,905,791 | 3/1990 | Garey | 181/282 |
| 4,909,348 | 3/1990 | Harwood et al. | 181/282 |

FOREIGN PATENT DOCUMENTS

| | | |
|---|---|---|
| 59-155528 | 9/1984 | Japan . |
| 59-43456 | 12/1984 | Japan . |
| 60-111011 | 6/1985 | Japan . |
| 61-14565 | 5/1986 | Japan . |
| 61-108821 | 5/1986 | Japan . |
| 61-155625 | 7/1986 | Japan . |
| 632013 | 1/1950 | United Kingdom . |
| 1012463 | 12/1965 | United Kingdom . |
| 2120318 | 11/1983 | United Kingdom . |

*Primary Examiner*—Benjamin R. Fuller

*Attorney, Agent, or Firm*—Anthony J. Casella; Gerald E. Hespos

[57] ABSTRACT

A stamp formed muffler includes upper and lower internal plates and upper and lower external shells secured to the respective internal plates. The internal plates are formed to include arrays of channels that are placed in register with one another to define an array of tubes. The external shells are formed to define chambers that surround selected tubes formed by the internal plates. The upper internal plate includes at least one pair of aligned channels disposed in spaced apart end-to-end relationship and in register with a continuous channel in the lower internal plate. The chambers of the external shells are separated from one another by baffle creases. The baffle crease of the upper external shell is disposed in registration with the spaced apart aligned channels of the upper external shell. As a result, the baffle crease of the upper external shell is substantially free of pockets that conceivably could trap foreign materials.

14 Claims, 2 Drawing Sheets

STAMP FORMED MUFFLER WITH POCKET-FREE BAFFLE CREASE

BACKGROUND OF THE INVENTION

The typical prior art exhaust muffler comprises a plurality of discrete tubes supported in parallel relationship to one another by a plurality of transversely extending baffles. The baffles generally will be of identical circular or oval peripheral configuration and will be aligned generally in register with one another. Some tubes in the array typically are perforated or louvered at selected locations along their length. Additionally, some tubes may extend greater distances than other tubes in the array. This typical prior art muffler further includes an outer shell that is wrapped around the transverse baffles such that the outer shell and adjacent baffles define chambers through which the tubes extend. The opposed ends of the muffler are closed by end caps or headers that are connected to the opposed ends of the tubular outer shell. The headers include at least one inlet and at least one outlet to provide communication with the chambers and tubes of the muffler. Inlet and outlet nipples or inlet and outlet tubes will extend through the inlet and outlet apertures of the headers to enable exhaust gas to flow into and out of the prior art muffler. Many prior art mufflers further include a separate outer wrapper which closely engages the outer shell for minimizing vibrations of the outer shell and the shell ring noise associated with such vibrations.

The above described prior art muffler generally is acceptable in attenuating the noise associated with the flow of exhaust gas from an engine. However, these prior art mufflers require a large number of separate components that must be manufactured and assembled in labor intensive manufacturing processes. The relatively large number of components may also result in an undesirable heavy muffler.

The conventional prior art muffler described above offers many internal design options but very few external design options. In particular, conventional prior art mufflers generally are limited to a rectangular plan view configuration, with the inlet and outlet extending from the opposed longitudinal ends. Unfortunately, the available space envelope on the underside of the vehicle often is not well suited to the rectangular shape required for the prior art conventional muffler. Thus, portions of the limited available space on the underside of the vehicle may not be properly utilized by the prior art muffler. This additional space often would help the exhaust system engineer to achieve the specified levels of noise and back pressure. Furthermore, the need to put inlet and outlet pipes at the opposed longitudinal ends of this prior art muffler often requires circuitous routing of the exhaust pipe and tail pipe with correspondingly great material costs.

Mufflers which comprise stamp formed components have been available for many years. Mufflers formed at least in part from stamped components offer the potential for reducing the number of components in the muffler. As a result, mufflers formed with stamped components can offer significant manufacturing efficiencies, at least partly in view of the potential for more automated manufacturing steps, as compared to conventional prior art mufflers.

The typical prior art stamp formed muffler has consisted of a pair of internal plates with opposed symmetrical registered channels defining an array of tubes, with portions of the tubes being perforated. The internal plates of the typical prior art stamp formed muffler are surrounded by a stamp formed external shell which defines a single large expansion chmber surrounding the perforated tubes. Prior art mufflers of this type generally are not able to satisfy the noise attenuation requirements for vehicles in the United States. More particularly, these prior art stamp formed mufflers often will be unable to adequately attenuate at least one narrow range of low frequency noise. Examples of prior art stamp formed mufflers of this general type are shown in British Patent No. 632,013 which issued to White in 1949; British Patent No. 1,012,463 which issued to Woolgar on Dec. 8, 1965; Japanese Published Patent Application No. 59-43456 which was published in 1984; and, U.S. Pat. No. 4,132,286 which issued to Hasui et al. on Jan. 2, 1979.

A slight variation of the above described typical prior art mufflers is shown in U.S. Pat. No. 4,415,059 which issued to Hayashi on Nov. 15, 1983 and shows a stamp formed straight-through muffler with two short punch formed tuning tubes extending transverse to the through tube. The muffler shown in U.S. Pat. No. 4,415,059 would not adequately attenuate all ranges of noise, such as low frequency noise.

Other prior art stamp formed mufflers have merely included a circuitous array of tubes and chambers. Noise attenuation in mufflers of this type presumably is achieved by the periodic expansion of the exhaust gases flowing from one of the tubular sections into one of the larger chambers. These mufflers also are functionally quite limited. Examples of mufflers of this type are shown in U.S. Pat. No. 3,638,756 which issued to Thiele on Feb. 1, 1972 and U.S. Pat. No. 3,176,791 which issued to Betts et al. on Apr. 6, 1965.

Still other prior art stamp formed mufflers include conventional tubular components disposed within a stamp formed outer shell. These prior art mufflers include UK Patent Application No. 21 120 318 and U.S. Pat. No. 4,109,751 which issued Kabele on Aug. 29, 1978.

Recently there have been several significant advances in stamp formed mufflers, as disclosed in patents and pending applications which are assigned to the assignee of the subject application. In particular, extremely effective and efficient mufflers are shown in U.S. Pat. No. 4,700,806 which issued on Oct. 20, 1987 to Jon Harwood and in U.S. Pat. No. 4,736,817 which issued from a continuation of the application leading to U.S. Pat. No. 4,700,806. These two patents show mufflers formed from a pair of plates that are formed to define an array of registered channels, with opposed channels defining an array of tubes. At least one of the tubes in the array defines a tuning tube having a length which extends along the abutting surfaces of the plates from which the tubes are formed. In this manner, the length and cross section of the tuning tube can be carefully selected in accordance with the frequency of the sound to be attenuated. The mufflers disclosed in U.S. Pat. Nos. 4,700,806 and 4,736,817 further include an external shell mounted to the plates and formed to define at least an expansion chamber and a low frequency resonating chamber which are separated from one another by a baffle crease. The low frequency resonating chamber is disposed to communicate with a corresponding tuning tube. The volume of the low frequency resonating chamber and the length and cross-sectional dimension of the tuning tube can be selected to properly attenuate one or more specific narrow ranges of low frequency noise that are not properly attenuated by the expansion chamber. Efficient methods and apparatus for manufacturing mufflers in accordance with U.S. Pat. Nos. 4,700,806 and 4,736,817 are shown in U.S. Pat. No. 4,847,865 which issued on July 18, 1989 and U.S. Pat. No. 4,860,853 which issued on Aug. 29, 1989. The two preceding patents also are assigned to the assignee of the subject invention.

Several of the mufflers shown in the above referenced patents owned by the assignee of the subject invention show a plurality of tubes passing through the baffle crease which separates the chambers of the muffler. This construction has led to the creation of pockets between the tubes passing through the baffle creases. The existence of these pockets does not appear to affect the life of the mufflers. However, it has been suggested that the pockets can accumulate foreign materials which conceivably could affect the metal in the vicinity of the pockets. U.S. Pat. No. 4,865,154 issued to Hanson et al. on Sept. 12, 1989 and attempts to address the undesirable accumulation of foreign material in the vicinity of pockets in the baffle crease of the muffler. More particularly, U.S. Pat. No. 4,865,154 provides holes passing vertically entirely through the pockets to enable drainage of foreign material that might otherwise accumulate in the pockets. It is believed, however, that any material that might accumulate in the pockets of the baffle crease would be in the nature of a thick sludge that would clog the drainage hole suggested by U.S. Pat. No. 4,865,154.

Several patents and pending applications that are assigned to the assignee of the subject invention provide more desirable options for eliminating pockets in the baffle crease of the muffler. For example, U.S. Pat. No. 4,836,330 which issued on June 6, 1989 shows a plural chamber muffler with only a single tube extending through the baffle crease. The provision of only one tube extending across the baffle crease avoids the creation of the potentially objectionable pockets. U.S. Pat. No. 4,860,853 issued on Aug. 29, 1989 to Walter G. Moring, III and shows mufflers where the tubes are defined between an internal plate and an external shell. Thus, the external shell does not have to deform down to meet the internal plate, and external pockets can be avoided. Still another muffler which avoids external pockets is shown in pending application Ser. No. 471,288 which was filed by VanBlaircum et al. on Jan. 26, 1990 and shows a muffler having at least one transverse tube which is disposed in register with the baffle crease. Thus, the baffle crease is of uniform depth and pockets can be avoided entirely. The disclosures of the above identified patents and pending applications that are assigned to the assignee of the subject invention ar incorporated herein by reference.

Although the above described prior art stamp formed mufflers that are assigned to the assignee of the subject invention offer many desirable features, there are some instances where the tuning requirements of the vehicle require a muffler with at least one baffle crease and with a plurality of tubes extending across the baffle crease. For these instances, it is desirable to provide a muffler that avoids the creation of pockets that conceivably could accumulate foreign materials.

In view of the above, it is an object of the subject invention to provide a stamp formed muffler that is substantially free of external pockets that could accumulate foreign materials.

Another object of the subject invention is to provide a stamp formed muffler having a plurality of chambers separated by a baffle crease, but with no pockets formed in the upwardly facing portion of the baffle crease.

An additional object of the subject invention is to provide a stamp formed muffler having a plurality of tubes extending across a baffle crease but without pockets defined in the upwardly facing portion of the baffle crease.

Still a further object of the subject invention is to provide a stamp formed muffler having a baffle crease separating two chambers and with only downwardly facing pockets defined in the baffle crease.

SUMMARY OF THE INVENTION

The subject invention is directed to an exhaust muffler which comprises a pair of plates secured in face-to-face relationship and at least one external shell secured to the plates. Each plate is formed to define an array of channels therein, such that the channels define an array of tubes or exhaust gas flow passages between the plates. More particularly the tubes defined by the formed plates include at least one inlet to the muffler and at least one outlet from the muffler. Portions of the tubes are provided with perforations, louvers or other such aperture means for permitting a controlled communication of exhaust gas from the tubes. At least one tube in the array may define a tuning tube having a length and a cross-sectional area which is selected in accordance with the characteristics of the noise to be attenuated. Portions of the tubes may be defined by generally identical and symmetrical opposed channels. However, at least selected portions of the tubes are defined by a planar portion of one plate and a channel in the other plate, as explained in greater detail herein.

The external shell is formed to include a peripheral portion, which may be a generally planar peripheral flange configured and dimensioned to be placed in generally face-to-face relationship with portions of at least one of the plates of the muffler. The external shell further is formed to define a plurality of chambers extending away from the peripheral portion of the external shell and surrounding selected tubes. The chambers of the external shell are separated from one another by a baffle crease which connects spaced apart locations on the periphery of the external shell and which extends into contact with the surface of one of the plates. In a typical embodiment one chamber defined by the external shell will be an expansion chamber which surrounds portions of the tubes having perforations, louvers or other such aperture means. At least one other chamber may define a low frequency resonating chamber which surrounds and communicates with a tuning tube defined by the plates. In a preferred embodiment, as described and illustrated herein, the muffler will comprise a pair of external shells which effectively surround the tubes defined by the plates.

At least two tubes are disposed to pass across the baffle crease from one chamber to the other. In prior art mufflers, portions of these tubes passing across the baffle crease have been defined by generally identical symmetrical opposed channels. As a result, pockets were defined in the baffle crease between adjacent tubes. These pockets conceivably could permit corrosive liquids to accumulate on the upper external shell. To avoid this potential problem, the portion of at least one tube passing across the baffle crease is defined by a planar portion on the upper plate and a channel on the opposed lower plate. Thus, the upper plate may be characterized by at least one pair of discontinuous channel sections which can be placed in register with at least one continuous channel in the lower plate. The planar portions defining the discontinuities in the channels of the upper plate are disposed in register with the baffle crease of the upper external shell. Accordingly, the base of the baffle crease will be formed to follow the planar shape of the plate, and will be substantially free of pockets.

A single tube crossing the baffle crease will not create a pocket. As a result, one of the plurality of tubes which cross the baffle crease may be defined by opposed channels in both the upper and lower plates. The single channel defined by the upper plate in the vicinity of the baffle crease will not create the potentially objectionable pockets.

The cross-sectional areas of tubes in a muffler are carefully engineered to achieve a specified back pressure and a gas flow path that will adequately attenuate noise. A reduction in the cross-sectional area of a tube can significantly increase back pressure levels with a corresponding negative effect on engine performance, and can also significantly affect the flow of exhaust gases through the muffler. The discontinuous channel in the upper plate in the vicinity of the baffle crease has the potential for reducing the cross-sectional area of the corresponding tube, and thereby increasing back pressure. Although a localized reduction in cross-sectional area may occasionally be desirable, it would be difficult to engineer mufflers to dispose the localized reduction of cross-sectional area exactly at the baffle crease. To avoid this localized reduction of cross-sectional area, the channels of the lower plate may be larger at locations disposed in register with planar portions of the upper plate. Thus, a continuous cross-sectional area for the tubes passing across the baffle crease can be provided.

DETAILED DESCRIPTION OF THE PREFERRED EMBODIMENT

Figure 1:
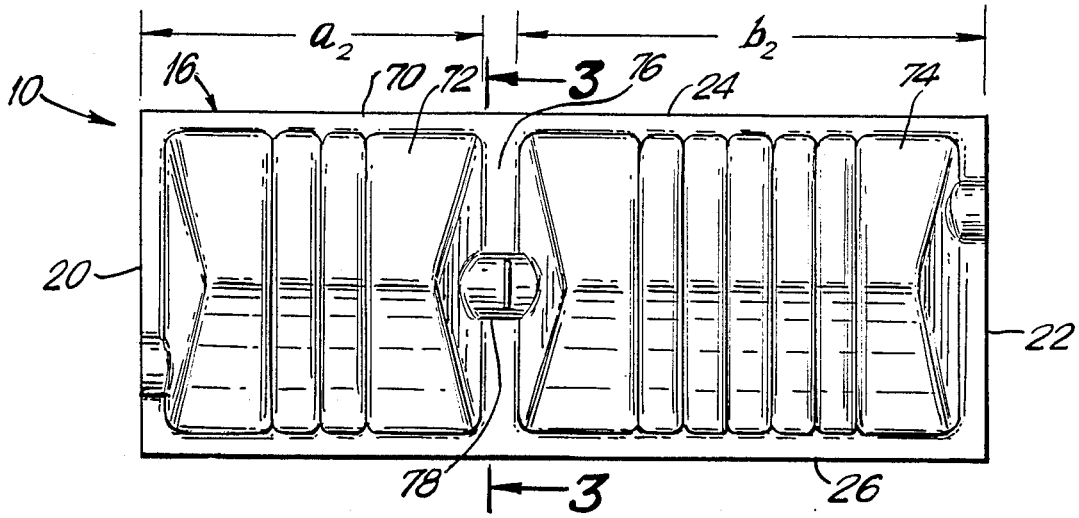
FIG. 1 is a top plan view of a muffler in accordance with the subject invention.

The muffler of the subject invention is identified generally by the numeral 10 in FIGS. 1-7. The muffler 10 comprises upper and lower internal plates 12 and 14 respectively and upper and lower external shells 16 and 18 respectively. The muffler 10 is depicted as being of generally rectangular plan view configuration with opposed first and second ends 20 and 22 and opposed longitudinal sides 24 and 26. However, it is to be understood that mufflers in accordance with the subject invention may assume various non-rectangular plan view configurations, with the particular shape being dependent at least in part on the shape of the available space envelope on the vehicle.

Figure 6:
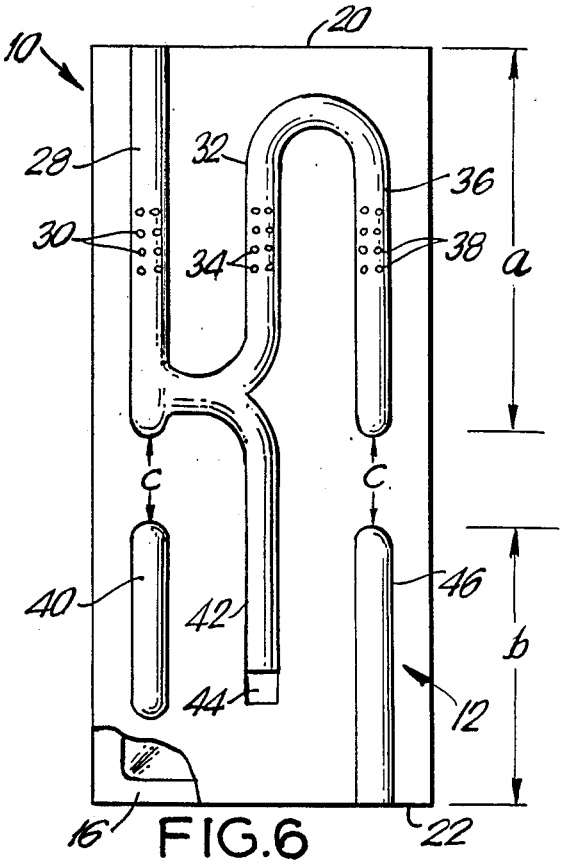
FIG. 6 is a top plan view of the muffler shown partly in section.

The upper internal plate 12 of the muffler 10 is shown most clearly in FIG. 6, and includes an array of channels formed therein. More particularly, the upper internal plate 12 includes an inlet channel 28 extending generally parallel to the opposed sides 24 and 26 of the muffler from a location at the first end 20 to a location spaced distance "a" from the first end 20 of the muffler 10. The inlet channel 28 is formed to include an array of perforations 30. The inlet channel 28 extends arcuately into a first return channel 32 which is aligned generally parallel to the inlet channel 28 and extends back toward the first end 20 of the muffler !0. An array of perforations 34 also is formed in the channel 32. The first return channel 32 extends arcuately into a second return channel 36 having perforations 38. The second return channel 36 is generally parallel to the channels 28 and 32 and extends to a location spaced a distance "a" from the first end 20 of the muffler 10.

The upper internal plate 12 further includes a first tuning channel 40 which is generally aligned in end-to-end relationship with the inlet channel 28, but which is spaced therefrom. In particular, the first tuning channel 40 begins at a location spaced distance "b" from the second end 22 of the muffler 10 and continues toward the second end 22 of the muffler 10 for a distance that is a function of the noise to be attenuated thereby. In the embodiment depicted herein, the first tuning channel 40 in the upper internal plate 12 is substantially free of apertures.

The upper internal plate !2 further includes a second tuning channel 42 which extends toward the second end 22 of the muffler 10 from a location at the arcuate intersection of the inlet channel 28 and the first return channel 32. The second tuning channel 42 extends continuously toward the second end 22 of the muffler 10 to terminate at an aperture 44 which is spaced a distance from the second end 22 of the muffler 10 which is less than the distance "b". The particular length and cross-sectional area defined by the second tuning channel 42 is selected in accordance with the tuning requirements of the muffler 10.

The upper internal plate 12 further includes an outlet channel 46 which is aligned in end-to-end relationship with the second return channel 36, but which is spaced therefrom. The outlet channel 46 extends to the second end 22 of the muffler from a location that is spaced a distance "b" from the second end 22.

As shown most clearly in FIG. 6, the distance "c" between the end of the inlet channel 28 and the first tuning channel 40 is substantially equal to the distance between the end of the second return channel 36 and the outlet channel 46.

Figure 7:
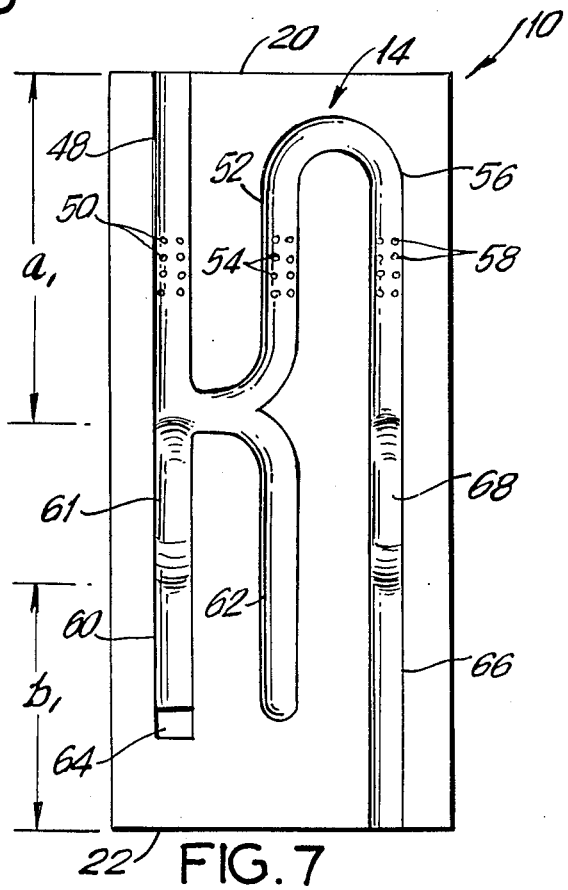
FIG. 7 is a cross-sectional view taken along line 7—7 in FIG. 3.

The lower internal plate 14 is shown most clearly in FIG. 7 and also is formed to include an array of channels. In particular, the lower internal plate 14 includes an inlet channel 48 which is disposed to be in register with the inlet channel 28 of the upper internal plate 12. The inlet channel 48 is provided with an array of perforations 50 to permit a controlled expansion of exhaust gas therefrom. A first return channel 52 extends arcuately from the inlet channel 48 back toward the first end 20 of the muffler 10 and generally in register with the first return channel 32 on the upper internal plate 12. The first return channel 52 also is provided with an array of perforations 54 formed therethrough. A second return channel 56 extends arcuately from the first return channel 52 and generally toward the second end 22 of the muffler 20. The second return channel 56 is disposed to be in register with the second return channel 36 of the upper internal plate 12, and is provided with an array of perforations 58 formed therethrough.

The lower internal plate 14 includes a first tuning channel 60 which is aligned with and extends continuously from the inlet channel 48. Portions of the first tuning channel 60 of the lower internal plate 14 is disposed to be substantially in register with the first tuning channel 40 of the upper internal plate 12. Additionally, the first tuning channel 60 includes a major dimensioned portion 61 adjacent to the inlet channel 48. As shown most clearly in FIG. 4, the major dimensioned portion 61 is defined by a deeper draw into the plane of the lower internal plate 14. However, in other embodiments, the major dimensioned portion 61 may be defined at least in part by a wider draw in the metal. The major dimensioned portion 61 extends from a location spaced distance "$a_1$" from the first end 20 of the muffler 10 to a location spaced a distance "$b_1$" from the second end 22 of the muffler 10. The distances "$a_1$" and "$b_1$" are less than the corresponding distances "a" and "b" on the upper internal plate 10. As a result, the major dimensioned portion 61 of the first tuning channel 60 enables communication with the inlet tube defined by channels 28 and 48 and with portions of the tuning tube defined in part by the first tuning channel 40 in the upper internal plate 12. The size of the major dimensioned portion 6 preferably is selected to achieve a first tuning tube of substantially constant cross-sectional area along it length. Thus, the cross-sectional area defined by the major dimensioned portion 61 of the first tuning channel 60 is substantially equal to the cross-sectional area defined by the first tuning channel 40 in the upper internal plate 12 and the opposed portion of the first tuning channel 60 in the lower internal plate 14. The first tuning channel 60 is further characterized by a tuning aperture 64 at the end thereof closest to the second end 22 of the muffler 10.

The lower internal plate 14 is further characterized by a second tuning channel 62 which extends continuously from a location adjacent the intersection of the inlet channel 48 and the first return channel 52. The second tuning channel 62 of the lower internal plate 14 is disposed to be in register with the second tuning channel 42 of the upper internal plate 12.

The lower internal plate 14 is further characterized by an outlet channel 66 which extends continuously from the second return channel 56, and which is disposed to be in register with the outlet channel 46 of the upper internal plate 12. The outlet channel 66 is connected to the second return channel 56 by a major dimensioned portion 68 which is disposed to overlap the discontinuity between the second return channel 36 and the outlet channel 46 of the upper internal plate !2. Thus, the major dimensioned portion 68 will provide for continuous communication between the tube defined by the second return channels 36 and 56 and the outlet tube defined by the outlet channels 46 and 66. The size of the major dimensioned portion 68 is selected to achieve a substantially constant cross-sectional area between the tube defined by the second return channels 36 and 56 and the outlet tube defined by the outlet channels 46 and 66.

The upper external shell 16 is illustrated most clearly in FIG. 1, and includes a generally planar peripheral flange 70 which is dimensioned to be secured in register with peripheral portions of the upper internal plate 12. An expansion chamber 72 extends upwardly from the peripheral flange 70 to surround and enclose the arrays of perforations 30, 34 and 38 formed in the upper internal plate 12. A low frequency resonating chamber 74 also extends upwardly from the peripheral flange 70 and is spaced from the expansion chamber 72 by a baffle crease 76 which extends transversely across the muffler 10 to connect spaced apart locations on the peripheral flange 70. The baffle crease 76 is configured to be in direct abutting contact with opposed portions of the upper internal plate 12. More particularly, the base of the baffle crease 76 extends from a location spaced a distance "$a_2$" from the first end 20 of the muffler 10 to a location spaced distance "$b_2$" from the second end 22 of the muffler 10. The distances "$a_2$" and "$b_2$" are greater than the distances "a" and "b" described above and depicted in FIG. 6. As a result, the base of the baffle crease 76 will be disposed substantially in line with the planar discontinuity between the inlet channel 28 and the first tuning channel 40 and the planar discontinuity between the second return channel 36 and the outlet channel 46. The baffle crease 76 includes a single arcuate convex portion 78 which conforms to and closely engages the second tuning channel 42 formed in the upper internal plate 12. However, other portions of the baffle crease 76 are substantially planar and free of pockets entirely across the upper external shell 16. Thus, the baffle crease 76 does not define any portions that conceivably could accumulate foreign materials.

Figure 2:
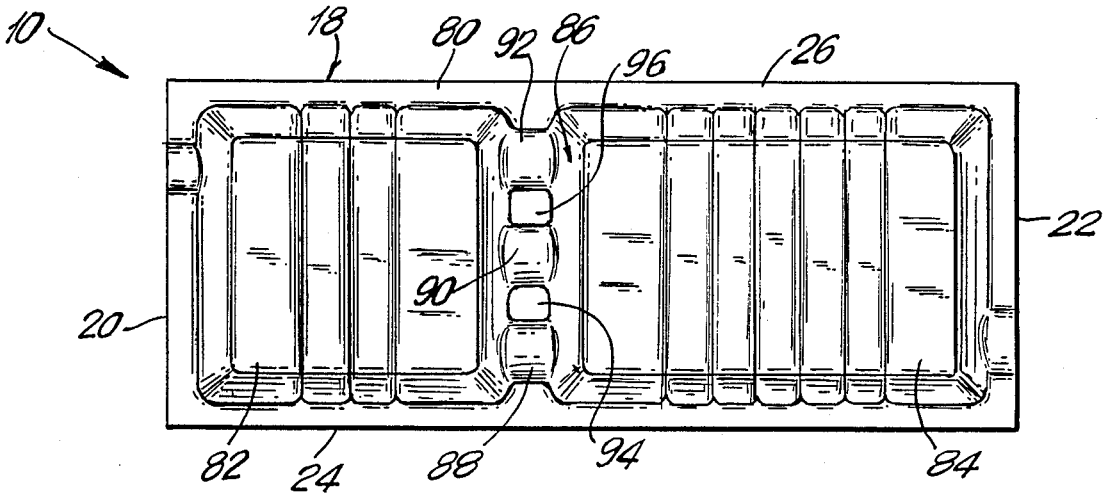
FIG. 2 is a bottom plan view of the muffler shown in FIG. 1.
Figure 3:
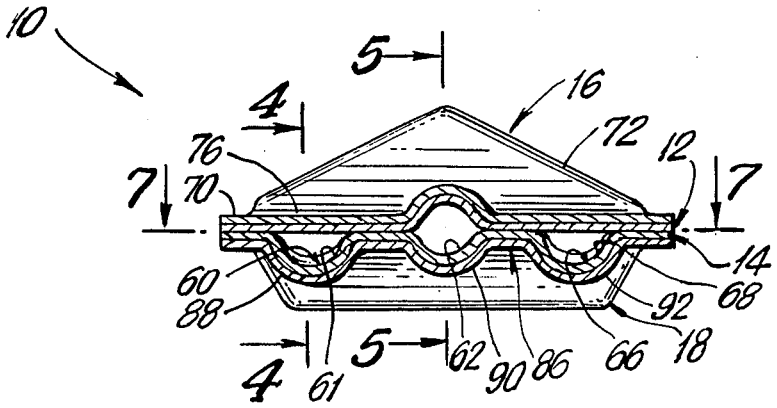
FIG. 3 is a cross-sectional view taken along line 3—3 in FIG. 1.
Figure 4:
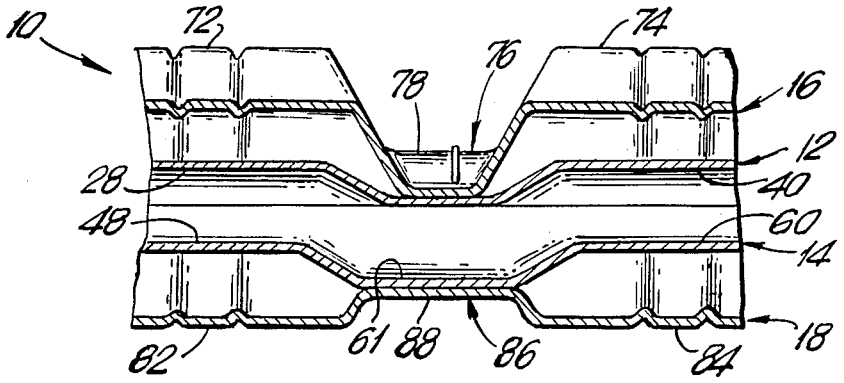
FIG. 4 is a cross-sectional view taken along line 4—4 in FIG. 3.
Figure 5:
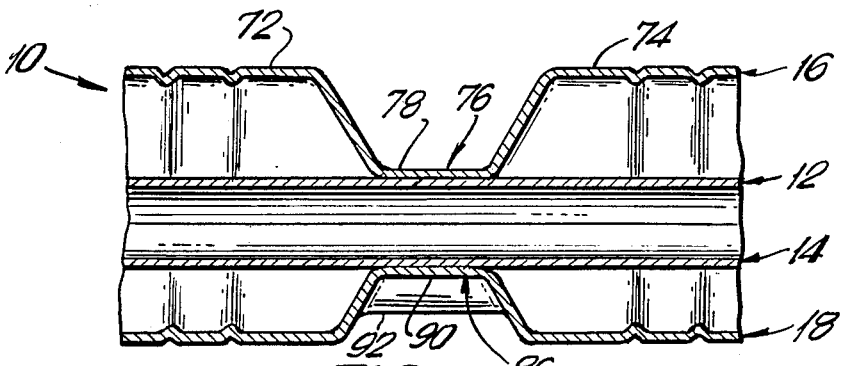
FIG. 5 is a cross-sectional view taken along line 5—5 in FIG. 3.

The lower external shell 18 is depicted most clearly in FIG. 2 and includes a generally planar peripheral flange 80 which is dimensioned to be secured in register with peripheral regions of the lower internal plate 14. An expansion chamber 82 extends downwardly from the peripheral flange 80 to surround and enclose the arrays of perforations 50, 54 and 58 formed in the lower internal plate 14. A low frequency resonating chamber 84 also extends downwardly from the peripheral flange 80 and is spaced from the expansion chamber 82 by a baffle crease which is identified generally by the numeral 86. The baffle crease 86 extends transversely across the lower external shell 18 to connect spaced apart locations on the peripheral flange 80. Additionally, the baffle crease is formed to extend into abutting contact with portions of the lower internal plate 14 adjacent thereto. Thus, the baffle crease 86 includes three downwardly extending convex arcuate portions 88, 90 and 92, respectively, which engage the first tuning channel 60, the second tuning channel 62 and the outlet channel 66. In particular, the arcuate portion 88 engages the major diameter portion 61 of the first tuning channel 60 in the lower internal plate 14. Similarly, the arcuate portion 92 engages the major dimensioned portion 68 of the outlet channel 66 in the lower internal plate 14. Thus, as depicted most clearly in FIG. 3, the arcuate portions 88 and 92 in the baffle crease 86 extend further downwardly than the arcuate portion 90. As depicted most clearly in FIG. 2, the baffle crease 86 defines pockets 94 and 96 therein intermediate the arcuate portions 88–92. However, as shown in FIG. 3, the pockets are directed downwardly and therefore do not accumulate fluids that conceivably could contribute to accelerated corrosion of the muffler 10.

In summary, the muffler of the subject invention comprises formed upper and lower internal plates and formed upper and lower external shells secured to the respective internal plates. The internal plates are formed to define arrays of channels disposed such that at least portions of the channels defined in the upper internal plate are registered with corresponding channels formed in the lower internal plate. The upper internal plate includes at least one pair of discontinuous channels which are in register with a continuous channel formed in the lower internal plate. The discontinuity between the aligned channels of the upper internal plate is disposed to be in line with a baffle crease formed between chambers of the upper external shell. With this construction, the baffle crease of the upper external shell is substantially free of pockets that conceivably could accumulate liquid or other foreign materials that may be considered undesirable. To achieve a continuous cross-sectional area along sections of the formed tubes, the lower external shell may include channels having a major cross-sectional dimension disposed in registration with the discontinuity of the channels in the upper internal plate. The changes in dimension of the channel in the lower internal plate is selected to achieve a substantially uniform cross-sectional area along the formed tubes.

While the invention has been described with respect to a preferred embodiment, it is apparent that various changes can be made without departing from the scope of the invention. For example, the muffler is not limited to the illustrated rectangular plan view configuration, and may assume any external shape that may be convenient for the available space on the vehicle. Additionally, the number, location and configuration of the tubes and the means for permitting expansion of gas from the tubes may vary considerably from the disclosed embodiments.

I claim:

1. An exhaust muffler comprising upper and lower internal plates disposed in face-to-face relationship with one another, each of said internal plates being formed to define an array of channels therein, said channels being disposed to define an array of tubes between said internal plates with said array of tubes defining at least one inlet to the muffler and at least one outlet from the muffler, said upper internal plate including at least one pair of channels disposed in spaced apart end-to-end relationship, said pair of channels being disposed in register with a continuous channel formed in the lower internal plate such that at least one of said tubes of said muffler is defined by the continuous channel of the lower internal plate and the pair of spaced apart channels of the upper internal plate, said muffler further comprising an upper external shell formed to define a peripheral portion and a plurality of chambers extending upwardly from said peripheral portion, said chambers being separated from one another by a baffle crease connecting spaced apart locations on the peripheral portion of said upper external shell, said peripheral portion of said upper external shell being securely connected to at least one of said internal plates such that the chambers thereof surround selected channels of the upper internal plate, said baffle crease being formed to be in face-to-face abutting contact with portions of said upper internal plate, including portions of said upper internal plate disposed between the pair of spaced apart channels thereof, whereby the baffle crease defined in the upper external shell is configured to prevent accumulation of foreign materials.

2. An exhaust muffler as in claim 1 wherein the upper internal plate includes first and second pairs of channels, with the channels in each said pair being in spaced apart end-to-end relationship, said first and second pairs of channels of the upper internal plate being disposed in registration respectively wit first and second substantially continuous channels in said lower internal plate, said baffle crease of said muffler being disposed in face-to-face abutting contact with portions of said upper external shell intermediate the spaced apart channels in each said pair of spaced apart channels thereof.

3. An exhaust muffler as in claim 1 further comprising a lower external shall formed to define at least one chamber therein, said lower external shell being securely connected to said lower internal plate.

4. An exhaust muffler as in claim 1 wherein the continuous channel of the lower internal plate includes a major dimensioned portion disposed in register with the portion of the upper internal plate intermediate the pair of spaced apart channels thereof, said major dimensioned portion being formed to provide a substantially uniform cross-sectional area for the tube defined by the continuous channel of the lower internal plate and the pair of spaced apart channels of the upper internal plate.

5. An exhaust muffler comprising upper and lower internal plates secured in face-to-face contact with one another, said upper and lower internal plates each being formed to define an array of channels therein, said channels being disposed to define an array of tubes between said upper and lower internal plates with said array of tubes defining at least on inlet to the muffler and at least one outlet from the muffler, at least one portion of said array of tubes being defined by a generally planar portion of said upper internal plate disposed in register with a continuous channel formed in the lower internal plate, selected portions of said tubes being provided with aperture means for permitting a controlled communication of exhaust gas from the tubes, said muffler further comprising upper and lower external shells secured to said upper and lower internal plates respectively, said upper external shell being formed to define at least first and second chambers extending away from the upper internal plate, said chambers being separated from one another by a baffle crease disposed in abutting contact with portions of the upper internal plate, including the planar portion of the upper internal plate disposed in register with the continuous channel of the lower internal plate, such that the baffle crease of the upper external shell is configured to prevent accumulation of foreign material.

6. An exhaust muffler as in claim 5 wherein the baffle crease of the upper external shell is formed to include a single convex portion disposed in engagement with one of said channels of said upper internal plate, remaining portions of said baffle crease disposed in contact with the upper internal plate being substantially planar for preventing accumulation of foreign materials in the baffle crease of the upper external shell.

7. An exhaust muffler as in claim 5 wherein said upper external shell includes a generally planar peripheral flange secured to said upper internal plate, said baffle crease connecting spaced apart locations on said peripheral flange, portions of said baffle crease intermediate said convex portion thereof and said peripheral flange being generally planar.

8. An exhaust muffler comprising upper and lower internal plates secured in face-to-face relation with one another, said upper and lower internal plates each being formed to define arrays of channels, with said arrays of channels being disposed to define an array of tubes comprising at least one inlet to the muffler and at least one outlet from the muffler, portions of said upper and lower internal plates intermediate the channels thereof being generally planar, said muffler further comprising upper and lower external shells, each said external shells comprising a peripheral flange securely connected to respective upper and lower internal plates and a plurality of chambers extending away from a respective peripheral flange and surrounding selected tube of the muffler, said chambers of each said external shells being separated from one another by baffle creases connecting spaced apart locations on the respective peripheral flange, said baffle creases being formed to extend into abutting contact with the respective internal plates, the baffle crease defined in the lower external shell comprising a plurality of downwardly extending convex portions dimensioned to engage a corresponding plurality of channels in the lower internal plate, the baffle crease of the upper external shell consisting of one upwardly extending convex portion engaging one of the channels in the upper internal plate and generally planar portions extending intermediate the convex portion and the peripheral flange of the upper external shell engaging planar portions of the upper internal plate, whereby the baffle crease of the upper external shell prevents accumulation of foreign materials therein.

9. An exhaust muffler as in claim 8 wherein the baffle crease of the upper external shell is disposed substantially in register with the baffle crease of the lower external shell.

10. An exhaust muffler as in claim 8 wherein a plurality of the tubes in the array are aligned to intersect the baffle creases of the external shells, a portion of at least one said tube intersecting the baffle creases being defined by a planar portion of said upper internal plate and an opposed channel in the lower internal plate.

11. An exhaust muffier as in claim 10 wherein each of said tubes intersecting the baffle creases defines a cross-sectional area at a location in line with the baffle crease substantially equal to cross-sectional areas on either side of said baffle crease.

12. An exhaust muffler comprising substantially rectangular upper and lower internal plates secured in face-to-face relationship with one another and comprising opposed first and second ends and opposed side edges, said internal plates being formed to define arrays of channels therein, with said channels being disposed to define an array of tubes, said tubes comprising at least one inlet extending from the first end of the internal plates and at least one outlet extending to the second end of the internal plates, at least one tube of the muffler including a longitudinally extending portion of generally semicircular cross section defined by a generally planar portion of said upper internal plate and a channel of the lower internal plate, said muffler further comprising upper and lower external shells comprising generally planar peripheral flanges affixed to the respective internal plates and a pair of chambers extending from an associated peripheral flange, said chambers being separated from one another by baffle creases extending between spaced apart locations on the peripheral flanges and being configured to be disposed in face-to-face contact with the respective internal plates, the baffle crease of the upper external shell being disposed in alignment with the semicircular tube portion such that the baffle crease of the upper external shell is substantially free of pockets, thereby preventing accumulation of foreign materials.

13. An exhaust muffler as in claim 12 wherein a plurality of said tubes include portions of generally semicircular cross section, said baffle crease of said upper external shell being aligned with said plurality of tube portions of semicircular cross section.

14. An exhaust muffler as in claim 12 wherein the tube portion of generally semicircular cross section defines a cross-sectional area substantially equal to cross-sectional areas of said tube adjacent to the portion of generally semicircular cross section.

* * * * *